US006931836B2

(12) United States Patent
Steinert

(10) Patent No.: US 6,931,836 B2
(45) Date of Patent: Aug. 23, 2005

(54) METHOD FOR $NO_X$ REDUCTION OF EXTERNALLY-IGNITED, EXPLOSION, INTERNAL COMBUSTION ENGINES

(75) Inventor: Ralf Steinert, Nürnberg (DE)

(73) Assignee: MAN Nutzfahrzeuge AG (DE)

( * ) Notice: Subject to any disclaimer, the term of this patent is extended or adjusted under 35 U.S.C. 154(b) by 86 days.

(21) Appl. No.: 10/441,777

(22) Filed: May 19, 2003

(65) Prior Publication Data

US 2003/0213229 A1 Nov. 20, 2003

Related U.S. Application Data

(63) Continuation-in-part of application No. 09/210,514, filed on Dec. 11, 1998, now abandoned.

(30) Foreign Application Priority Data

Dec. 12, 1997 (DE) ..... 197 55 299

(51) Int. Cl.[7] ..... F01N 3/00

(52) U.S. Cl. ..... 60/274; 60/285; 60/297; 123/305; 123/406.14; 123/406.17; 123/406.26; 123/406.27; 123/406.41

(58) Field of Search ..... 60/274, 285, 297; 123/305, 406.13, 406.14, 406.17, 406.22, 406.26, 406.27, 406.41, 406.44

(56) References Cited

U.S. PATENT DOCUMENTS

| | | | | | |
|---|---|---|---|---|---|
| RE34,234 | E | * | 4/1993 | Kuroiwa et al. | 123/425 |
| 5,732,554 | A | * | 3/1998 | Sasaki et al. | 60/278 |
| 5,775,099 | A | * | 7/1998 | Ito et al. | 60/274 |
| 5,797,367 | A | * | 8/1998 | Iida et al. | 123/295 |
| 5,839,275 | A | * | 11/1998 | Hirota et al. | 60/285 |

* cited by examiner

*Primary Examiner*—Binh Q. Tran
(74) *Attorney, Agent, or Firm*—Robert W Becker & Associates; Robert W Becker

(57) ABSTRACT

In a method for reducing $NO_x$ in the exhaust gas of an externally ignited, explosion-type internal combustion engine that is operated at a lean fuel/air ratio of $\lambda>1$ and has a motor control device for controlling $\lambda$, the $\lambda$ value is slidingly controlled as a function of an average mass temperature in the combustion chamber of the externally ignited, explosion-type internal combustion engine, wherein for a low average mass temperature $\lambda$ is decreased and for a high average mass temperature $\lambda$ is increased such that the internal combustion engine is operated in any operational state close to the misfiring limit, and thereby, with the most minimal $NO_x$ emission possible.

4 Claims, No Drawings

METHOD FOR $NO_X$ REDUCTION OF EXTERNALLY-IGNITED, EXPLOSION, INTERNAL COMBUSTION ENGINES

The present application is a continuation-in-part of U.S. application Ser. No. 09/210,514, filed Dec. 11, 1998, now abandoned.

BACKGROUND OF THE INVENTION

The present invention relates to a method for reducing $NO_x$ of externally ignited, explosion-type internal combustion engines in which the externally ignited, explosion-type internal combustion engine is operated at an air ratio of $\lambda>1$ in a lean mode and the $\lambda$ value of the fuel/air mixture is controlled by an engine control device.

For the purpose of reducing the $NO_x$ values in the exhaust gas of externally ignited, explosion-type internal combustion engines it is known to operate them with a lean mixture at $\lambda>1$. Because of the high average mass temperature in the combustion chamber during stationary operation, high $\lambda$ values must be selected in order to achieve low $NO_x$ emission.

Difficulties arise during non-stationary operation, for example, during acceleration from low engine rpm (revolutions per minute), when the average mass temperature in the combustion chamber is lower than during stationary operation and the misfire limit moves toward lower $\lambda$ values.

It is therefore an object of the present invention to control the $\lambda$ value of an externally ignited, explosion-type, or gas, internal combustion engine that is always operated at a lean fuel/air ratio of $\lambda>1$, where $\lambda$ is controlled by an engine control device of the internal combustion engine, such that, for the purpose of $NO_x$ reduction, the engine is operated close to the misfire limit.

SUMMARY OF THE INVENTION

Inventively, this object is solved in that the $\lambda$ value is slidingly controlled as a function of the average mass temperature in the combustion chamber of the externally ignited, explosion-type, internal combustion engine such that for low average mass temperature the $\lambda$ value is decreased and for high average mass temperature the $\lambda$ value is increased so that the internal combustion engine, under any operating condition, is operated close to the misfire limit, or in other words, operates in any operational state close to faultless engine operation.

Since the control of $\lambda$ is based on the average mass temperature, the fuel/air mixture can be made so lean or so rich that the misfire limit is almost reached but not surpassed. The $NO_x$ reduction process is thus expanded to its physically possible limit.

As noted above, the method of the present invention is concerned specifically with a retiming of the firing or ignition point of externally ignited, internal combustion engines, for example, gas engines, also commonly known as "explosion" engines. With gas or explosion engines, the fuel-air mixture $\lambda$ can only be varied within very narrow limits, specifically, between an upper and lower ignition limit.

The present invention proposes to lower the lower ignition limit to such a point that no misfiring occurs, but to lower the lower ignition limit by lowering the combustion temperature, as determined by the exhaust gas. As a result of this lowering of the combustion temperature, a noticeable decrease of the $NO_x$ concentration results. The average mass temperature is used as the control maximum for $\lambda$. With a hot or warm engine, $\lambda$ can be greater than with a cold engine.

DESCRIPTION OF PREFERRED EMBODIMENTS

An advantageous possibility for determining the average mass temperature is as follows. The exhaust gas temperature is measured by a temperature sensor and the measured exhaust gas temperature, which is a measure of the average mass temperature, is employed in the controlling step. The exhaust gas temperature reflects the average mass temperature so that the exhaust gas temperature can be used as a substitute for the average mass temperature. The exhaust gas temperature can be easily determined by a temperature sensor and can be used in the engine control device for controlling the $\lambda$ value.

Another advantageous embodiment is as follows. With the aid of the engine control device, the exhaust gas temperature is calculated based on one or more operational parameters of the externally ignited, explosion-type, internal combustion engine. The operational parameters include load, engine rpm, coolant temperature, and atmospheric temperature etc. The calculated exhaust gas temperature, that is a function of the average mass temperature, is then used in the step of controlling. Since the exhaust gas temperature is dependent on the average mass temperature, the calculated exhaust gas temperature can be used as a substitute control signal by the engine control device for the purpose of controlling the $\lambda$ value.

According to another embodiment of the invention, the cylinder pressure curve of the externally ignited, explosion-type, internal combustion engine is measured and, based on the measured curve, the average mass temperature is calculated. A pressure sensor is used to measure the pressure curve of the cylinder and then the average mass temperature is calculated therefrom and employed for controlling the $\lambda$ value.

The invention is based on the recognition that the $\lambda$ value is not a fixed value, but that the critical limit for $\lambda$ in the dynamic range of the engine has no set value. That is, the critical limit for $\lambda$ is a sliding limit that depends on the average mass temperature in the combustion chamber.

The problem is that the currently known temperature sensors are too slow to make direct use of the average mass temperature for a sliding control of the maximum $\lambda$ value possible according to physical principles. According to the methods of the prior art, it is necessary to lower $\lambda$ in the dynamic range of operation in order to prevent misfiring. The lowering of the $\lambda$ value, however, results in increased $NO_x$ concentrations in the exhaust gas.

The inventive method suggests treating the $\lambda$ value as a function of the average mass temperature of the fuel/air mixture to be compressed within the combustion chamber. Since this average mass temperature cannot be determined directly, it is inventively suggested to determine the average mass temperature based on measurable parameters, for example, by measuring the exhaust gas temperature with the aid of a temperature sensor and to then either calculate the average mass temperature with the aid of the engine control device as a function of the measured exhaust gas temperature and use the calculated result for controlling the maximum allowable $\lambda$ value or to use the exhaust gas temperature as a substitute for the average mass temperature for adjusting the $\lambda$ value.

Rather than measuring the exhaust gas temperature, a further option suggests calculating the exhaust gas temperature based on parameters such as load, engine rpm, coolant temperature and atmospheric temperature, with the aid of the engine control device, and determining the average mass temperature to thereby control the λ value based on the determined exhaust gas temperature.

A further option for a sliding control of the λ value is to measure the cylinder pressure curve by a pressure sensor. With the aid of a combustion analysis the average mass temperature can be calculated and the λ value can be controlled.

The inventive method allows control of the λ value in the dynamic operational ranges of the externally ignited, explosion-type combustion engine up to the misfire limit of the engine without ever surpassing the misfire limit, such that the engine is in operated in any operational state close to faultless engine operation The maximum exploitation of the theoretically possible spectrum of the λ value ensures a minimization of the pollutant component in the exhaust gas, especially of $NO_x$.

As previously noted, the present invention relates specifically to a retiming of the firing or ignition point of externally ignited, internal combustion engines, for example, gas engines, also commonly known as "explosion" engines. With gas or explosion engines, the fuel-air mixture λ can only be varied within very narrow limits, specifically, between an upper and lower ignition limit.

The present invention is, of course, in no way restricted to the specific disclosure of the specification and drawings, but also encompasses any modifications within the scope of the appended claims.

What is claimed is:

1. A method for reducing $NO_x$ in the exhaust gas of an internal combustion engine, said method comprising the step of:

slidingly controlling λ as a function of an average mass temperature in the combustion chamber of the externally ignited, explosion internal combustion engine, wherein for a low average mass temperature λ is decreased and for a high average mass temperature λ is increased such that the externally ignited, explosion internal combustion engine is operated in any operational state close to faultless engine operation, wherein said internal combustion engine is an externally ignited, explosion internal combustion engine that is operated at a lean fuel/air ratio of $\lambda>1$, wherein λ is controlled by an engine control device.

2. A method according to claim 1, further comprising the step of measuring the exhaust gas temperature by a temperature sensor and employing the exhaust gas temperature, which is a measure of the average mass temperature, in the step of controlling λ.

3. A method according to claim 1, further comprising the step of calculating with the aid of the engine control device the exhaust gas temperature based on one or more operational parameters of the externally ignited, explosion internal combustion engine, said operational parameters selected from the group consisting of load, engine rpm, coolant temperature, and atmospheric temperature, and employing the exhaust gas temperature, which is a measure of the average mass temperature, in the step of controlling λ.

4. A method according to claim 1, further comprising the step of measuring a cylinder pressure curve of the internal combustion engine and calculating the average mass temperature based on the cylinder pressure curve.

* * * * *